US010703528B2

(12) United States Patent
Delause et al.

(10) Patent No.: US 10,703,528 B2
(45) Date of Patent: Jul. 7, 2020

(54) PACKAGING WITH CENTERING ELEMENTS, BLANK, SET OF BLANKS, DEVICE AND METHOD FOR CREATING PACKAGING OF THIS KIND

(71) Applicant: DS Smith Packaging France, Puteaux (FR)

(72) Inventors: Bernard Delause, Epinal (FR); Didier Desertot, Arc-sur-Tille (FR)

(73) Assignee: DS Smith Packaging France, Puteaux (FR)

( * ) Notice: Subject to any disclaimer, the term of this patent is extended or adjusted under 35 U.S.C. 154(b) by 0 days.

(21) Appl. No.: 16/082,976

(22) PCT Filed: Feb. 10, 2017

(86) PCT No.: PCT/FR2017/050308
§ 371 (c)(1),
(2) Date: Sep. 7, 2018

(87) PCT Pub. No.: WO2017/153650
PCT Pub. Date: Sep. 14, 2017

(65) Prior Publication Data

US 2019/0112093 A1 Apr. 18, 2019

(30) Foreign Application Priority Data

Mar. 7, 2016 (FR) ..... 16 51875

(51) Int. Cl.
*B65D 5/42* (2006.01)
*B65D 5/00* (2006.01)
(Continued)

(52) U.S. Cl.
CPC ..... *B65D 5/427* (2013.01); *B31B 50/06* (2017.08); *B31B 50/142* (2017.08);
(Continued)

(58) Field of Classification Search
CPC ..... B65D 5/427; B65D 5/001; B65D 5/0015; B65D 5/321; B65D 5/4266; B65D 5/4608;
(Continued)

(56) References Cited

U.S. PATENT DOCUMENTS 2,719,664 A * 10/1955 Hester ..... B65D 5/0035 229/120.01
6,899,266 B2 * 5/2005 Conway ..... B65D 5/0025 229/169
(Continued)

FOREIGN PATENT DOCUMENTS

DE 2014105771 U1 1/2015
FR 2311717 A1 12/1976
(Continued)

OTHER PUBLICATIONS

International Search Report of PCT/FR2017/050308, dated Apr. 18, 2017.

*Primary Examiner* — Christopher R Demeree
(74) *Attorney, Agent, or Firm* — Banner & Witcoff, Ltd.

(57) ABSTRACT

The present invention relates to material packaging made of corrugated cardboard sheet having a polygonal cross section, comprising lateral walls, a lower plane forming the bottom of the packaging, and an opposite upper plane. It comprises at least one portion (25, 26) projecting with respect to the upper plane. The bottom (30) comprises at least one surface portion (15, 16) that is cut out over a portion of the thickness of the cardboard sheet, is compressed and in the form of a non-through hollow, referred to as a hollow portion, the shape of which matches the projecting portion, in line with the latter and arranged to fit together with the projecting portion of the packaging below.

26 Claims, 12 Drawing Sheets

(51) Int. Cl.

| | |
|---|---|
| ***B65D 5/32*** | (2006.01) |
| ***B65D 5/468*** | (2006.01) |
| ***B65D 5/68*** | (2006.01) |
| ***B31B 50/14*** | (2017.01) |
| ***B31B 50/25*** | (2017.01) |
| ***B31B 50/59*** | (2017.01) |
| ***B31B 50/06*** | (2017.01) |
| *B31B 120/10* | (2017.01) |
| *B31B 105/00* | (2017.01) |
| *B31B 110/30* | (2017.01) |
| *B31B 120/30* | (2017.01) |
| *B31B 110/35* | (2017.01) |
| *B31B 120/70* | (2017.01) |
| *B31B 50/04* | (2017.01) |

(52) U.S. Cl.

CPC ..... *B31B 50/252* (2017.08); *B31B 50/59* (2017.08); *B65D 5/001* (2013.01); *B65D 5/0015* (2013.01); *B65D 5/321* (2013.01); *B65D 5/4266* (2013.01); *B65D 5/4608* (2013.01); *B65D 5/68* (2013.01); *B31B 50/042* (2017.08); *B31B 2105/0024* (2017.08); *B31B 2110/30* (2017.08); *B31B 2110/35* (2017.08); *B31B 2120/10* (2017.08); *B31B 2120/302* (2017.08); *B31B 2120/70* (2017.08)

(58) Field of Classification Search

CPC ..... B65D 5/68; B65D 5/22; B65D 21/0212; B65D 21/0223; B65D 5/005; B65D 21/0204

USPC ... 229/117.01, 198.2, 122.29, 143, 147, 149, 229/174, 916; 206/509, 503, 508

See application file for complete search history.

(56) References Cited

U.S. PATENT DOCUMENTS

| | | | | |
|---|---|---|---|---|
| 2004/0074801 | A1* | 4/2004 | Ritter | B65D 5/003 206/509 |
| 2004/0149815 | A1* | 8/2004 | Holdsworth | B65D 5/0035 229/164 |
| 2005/0045517 | A1* | 3/2005 | Holdsworth | B65D 5/0035 206/509 |
| 2011/0000957 | A1* | 1/2011 | Delause | B65D 5/001 229/125.01 |

FOREIGN PATENT DOCUMENTS

| | | | |
|---|---|---|---|
| FR | 2986513 | A1 | 8/2013 |
| FR | 2990416 | A1 | 11/2013 |

* cited by examiner

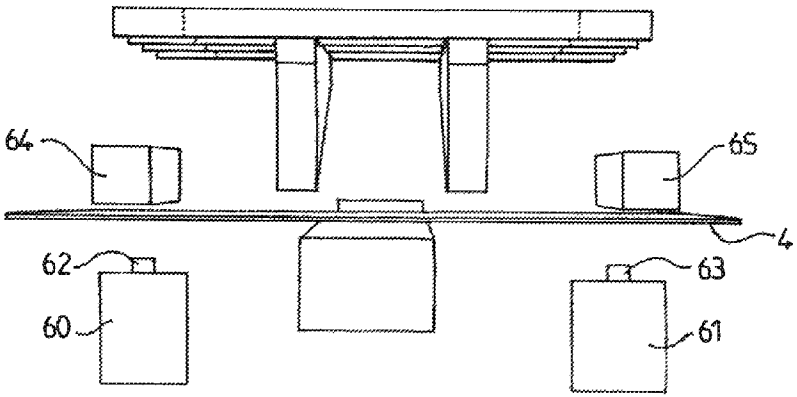
FIG.4
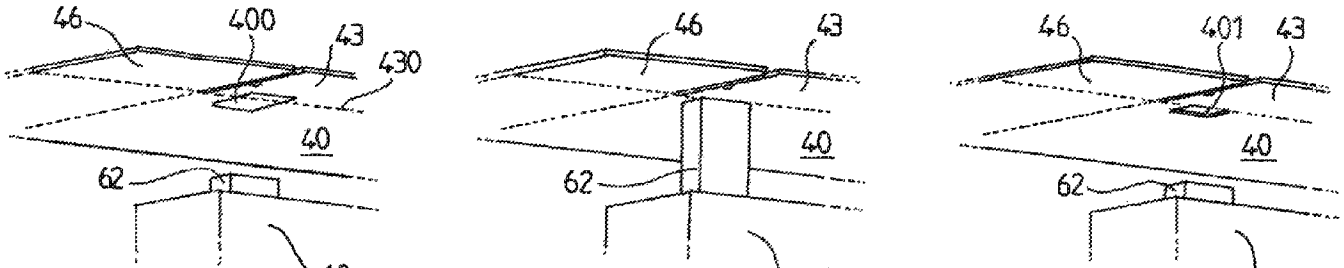
FIG.5A
FIG.5B
FIG.5C

PACKAGING WITH CENTERING ELEMENTS, BLANK, SET OF BLANKS, DEVICE AND METHOD FOR CREATING PACKAGING OF THIS KIND

The present invention concerns material packaging made of corrugated cardboard sheet having a polygonal section, including lateral walls, a lower plane forming the bottom of the packaging, and an opposite upper plane, said packaging including centering members.

By centering member is meant elements situated in the lower plane and in the upper plane of the packaging that will enable their centered positioning when stacking them during storage or transportation.

It also concerns blanks and a device and a method for producing such packaging and more particularly for forming their centering elements.

It finds a particularly important, although non-exclusive, application in the field of boxes that can be stacked on a pallet, which may tend to slide relative to one another during their manipulation during transportation phases.

Systems are already known for centering boxes making it possible to prevent them sliding, by means of lateral tenons that come to cooperate with orifices placed on or near the edges.

Such systems are fragile and do not withstand repeated manipulation.

Also known (FR 2 311 717) is packaging in which the lid is formed of flaps some of which are of complementary shape to notches formed in the bottom, also formed of flaps, enabling fitting together and therefore lateral immobilization.

This embodiment is not suitable for low weights per unit area and does not always allow perfectly vertical stacking, because of the offsets that may exist during the formation of the case.

Also known (FR 2 990 416 or FR 2 986 513) are boxes with centering members made of corrugated cardboard sheet and having a polygonal section, including lateral walls, a lower plane forming the bottom of the packaging and an opposite upper plane together with at least one portion projecting relative to the upper plane. In these boxes openings are formed in the bottom of the packaging by cutting and ejection, thus constituting a cavity to receive the projecting portion situated on the bottom of the box on top. However, this kind of arrangement creates a hole in the bottom of the packaging if the latter includes only one thickness of cardboard, which represents a disadvantage.

There may equally be cited the document DE 20 2014 105 771 which describes a box of the same type in which the projecting portions and the openings have a frustoconical shape.

The present invention aims to provide packaging, a blank, a set of blanks, a device and a method for forming packaging representing a better response than those known before to the requirements of practice, notably in that it proposes centering of the packaging on one another with no risk of degrading the centering means that will be used, in that it allows formation of simple packaging of relatively low cost and in that it enables the avoidance of the holes in bottoms including only one thickness of cardboard, which would otherwise create a break in the confinement of the contents of the packaging relative to the outside.

With the invention, it will therefore be possible, whilst preventing any sliding of the packaging when stacked on one another during their palletization, to allow the use of a low weight per unit surface area. Likewise, packaging having a bottom made of only one thickness of cardboard remains sealed, which also in particular makes it possible to avoid the use of costly palletization accessories generating additional handling.

To this end, the present invention proposes in particular material packaging made of corrugated cardboard sheet having a polygonal section, including lateral walls, a lower plane forming the bottom of the packaging, and an opposite upper plane, comprising at least one portion projecting with respect to the upper plane, characterized in that the bottom comprises at least one surface portion that is cut over a portion of the thickness of the cardboard sheet, compressed and in the form of a non-through hollow, of complementary shape to said projecting surface portion, in line with the latter and adapted to fit together with the projecting surface portion of the packaging underneath.

By surface portion of complementary shape is meant a plane opening sized so that the projecting portion that is inserted therein comes to abut on at least one portion of the periphery of the opening, which enables prevention of longitudinal and transverse movements in the horizontal plane of one packaging relative to the other.

This packaging may in particular take the form of a box the upper plane of which is an upper wall constituting the top of the box, said at least one projecting portion being formed by a surface portion of the upper wall.

It may equally take the form of a tray the upper plane of which is an open face.

Advantageous embodiments moreover and/or additionally have recourse to one and/or the other of the following features:

- the projecting surface portion is formed by a tongue folded and glued onto the top of the box;
- the projecting surface portions are symmetrical with respect to the transverse axis and/or to the center of the box and formed by tongues folded and glued onto the exterior face of the top of said box;
- the lower wall and the lateral walls are formed at least in part by a tray and the upper wall by a lid provided with lateral flaps covering at least in part the lateral walls of the tray;
- the tongues are flaps connected by fold lines to secondary flaps themselves connected to said main flap of the lid;
- the packaging is formed by a sequence of at least four main sections adapted to form the lateral walls and by four sets of two facing lateral flaps connected in pairs to each of the main sections to form once folded the bottom and the top of the packaging;
- each tongue is formed by a flap connected by a fold line to a main section;
- tongues are formed by a cut-out in the upper wall of the box to which they are connected by a fold line;
- the bottom and the top of the box include a projecting portion and a hollow portion symmetrical with respect to the transverse axis and with respect to the center of the box;
- the lateral walls being connected to the bottom by junction lines, the compressed surface portions straddle the junction line and/or have a side beside said junction line;
- the hollow portions are far from the junction lines connecting the lateral walls to the bottom;
- the projecting portion is formed by a convex tongue situated in one corner of the upper plane of the tray;
- two lateral walls of the tray include a pair of facing secondary flaps, at least one of them being folded on itself thanks to fold lines to form the projecting portion.

In advantageous embodiments the compressed non-through hollow surface portion or opening has a thickness e between ¼ and 9/10 inclusive the thickness of the corrugated cardboard, for example equal to half said thickness, for example e between 0.5 and 4 mm inclusive.

The packaging advantageously has eight sides, namely four main lateral walls and four intermediate lateral walls forming cutaway corners.

The packaging equally advantageously comprises two sets of two compressed cut-out portions symmetrical with respect to the transverse axis of the box.

The invention also proposes a blank or set of blanks enabling such packaging to be obtained.

It equally and in particular proposes a blank or set of blanks made of corrugated cardboard sheet intended to form packaging of polygonal section including lateral walls, a lower plane forming the bottom of the packaging and an opposite upper plane, characterized in that, the packaging comprising at least one portion projecting relative to the upper plane and the bottom comprising at least one compressed non-through hollow surface portion, termed a hollow portion, cut over a portion of the thickness of the cardboard sheet, of complementary shape to said projecting portion, and adapted to be fitted together with the projecting portion of the packaging underneath when it is in line with the latter, once the packaging has been formed to shape.

The set of blanks advantageously comprises a first blank comprising the lower wall formed by a rectangular first main section forming the bottom provided on each of its sides with a flap or a secondary flap to form the lateral walls of a tray and a second blank comprising the upper wall.

The upper wall may be formed by a rectangular second main section forming the top, provided on each of its sides with a second main flap to form the lateral walls of a lid of the packaging once erected.

The second blank may equally be formed by a sequence of at least four main sections adapted to form the lateral walls of the lid and by four lateral flaps connected to each of the main sections to form the top of a lid once folded contiguously.

In another advantageous embodiment, the blank is formed by a sequence of at least four main sections adapted to form the lateral walls of a box and by four sets of two facing lateral flaps connected in pairs to each of the main sections to form the bottom and the top of the box once folded contiguously.

In another embodiment, the blank comprises a main section forming the bottom of a tray, provided on each of its sides with a main flap to form the lateral walls of the tray, once erected.

The cut and compressed surface portions are advantageously of trapezoidal shape.

Equally advantageously, the lateral walls being connected to the bottom by junction lines, the cut and compressed surface portions straddle the junction line and/or have a side beside said junction line.

The invention equally proposes a method and a device for forming packaging as described hereinabove and in particular and more particularly for forming at least one centering member for such packaging.

It also proposes a device for forming packaging and/or at least one centering member of such packaging made of corrugated cardboard sheets and having a polygonal section, including lateral walls, a lower plane forming the bottom of the packaging and an opposite upper plane, said member comprising a hollow portion provided on the lower face of the bottom and a portion projecting relative to the upper plane of the packaging of complementary shape to and in line with said hollow portion, characterized in that the device includes means for bringing the wall forming the bottom of the packaging into a particular position, in that, at least one surface portion of the external face of said bottom having been cut beforehand over a portion of the thickness of the cardboard sheet forming the bottom, it further includes at least one part for compressing said cut surface, at least one counter-pressure member facing said compression part, and pusher means adapted to compress said cut surface portion between the compression part and the counter-pressure member to form said portion in the form of a non-through hollow.

The counter-pressure member advantageously takes the form of a former.

The invention equally proposes a method of forming packaging and/or centering members as described hereinabove.

It also proposes a method of forming packaging made of corrugated cardboard sheet having a polygonal section, including lateral walls, a lower plane forming the bottom of the packaging and an opposite upper plane, from at least one blank featuring a panel adapted to form said bottom, characterized in that the wall forming the panel intended to form the bottom of the packaging is brought into a particular position, at least one surface portion of the external face of the bottom having been cut beforehand over a portion of the thickness of a cardboard sheet forming said bottom, said cut surface portion is compressed by exerting a counter-pressure opposite said compression to form a non-through hollow surface portion.

It should be noted that this step of forming a hollow portion is applicable to any type of packaging and to any type of device designed to produce this packaging.

The invention will be better understood on reading the following description of embodiments given hereinafter by way of nonlimiting example.

The description refers to the drawings that accompany it, in which:

FIG. 4 is a diagrammatic transverse perspective view of a portion of a device according to one embodiment of the invention.

FIGS. 5A to 5C are partial perspective views from below showing the steps of producing a non-through hollow obtained with the device from FIG. 4.

Figure 1A:
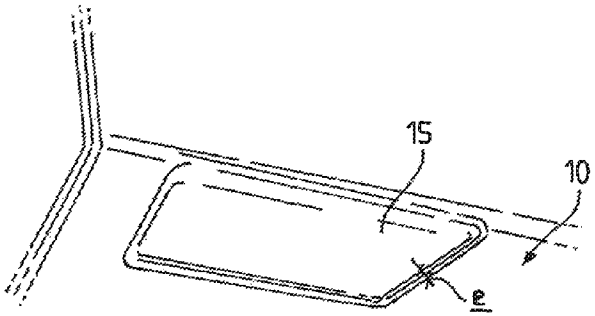
FIG. 1A is a view to a larger scale of a non-through hollow from FIG. 1.
Figure 1:
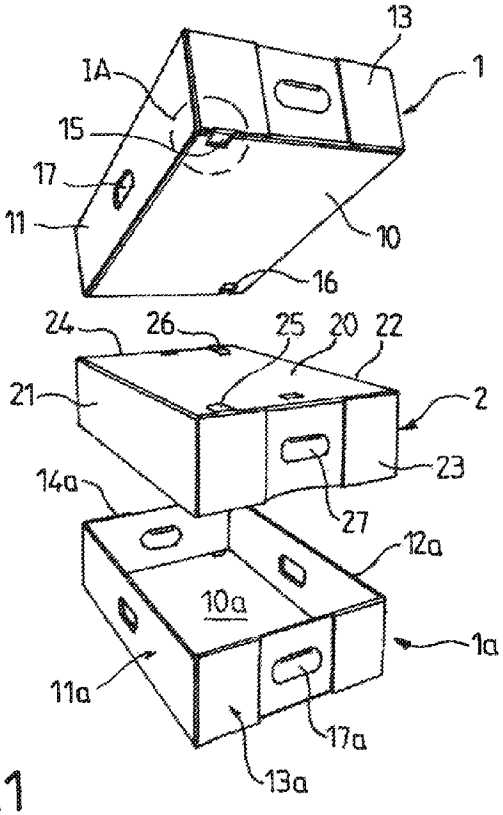
FIG. 1 is a perspective view showing the nesting of two packagings according to one embodiment of the invention in the form of boxes with tray and lid.
Figure 7A:
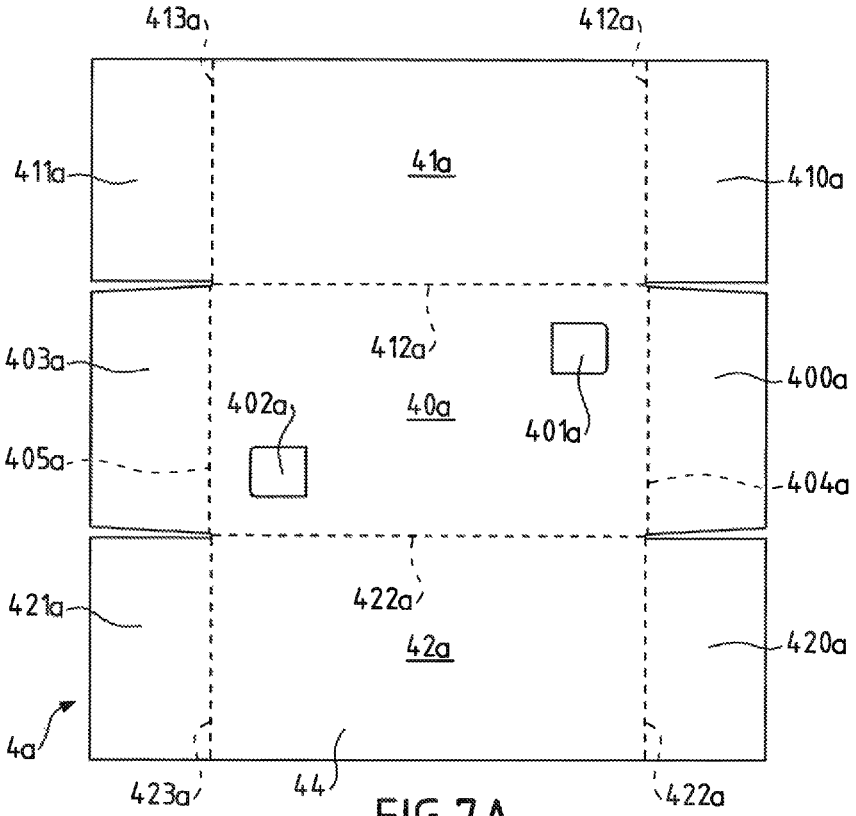
Figure 7B:
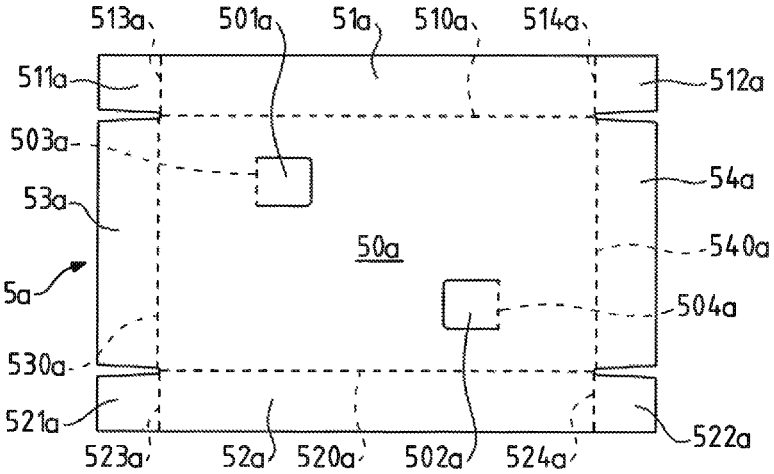

FIG. 7 comprises FIGS. 7A and 7B which are respectively views from above of a first blank forming the tray and a second blank forming the lid of a variant of the box from FIG. 1.

Figure 8A:
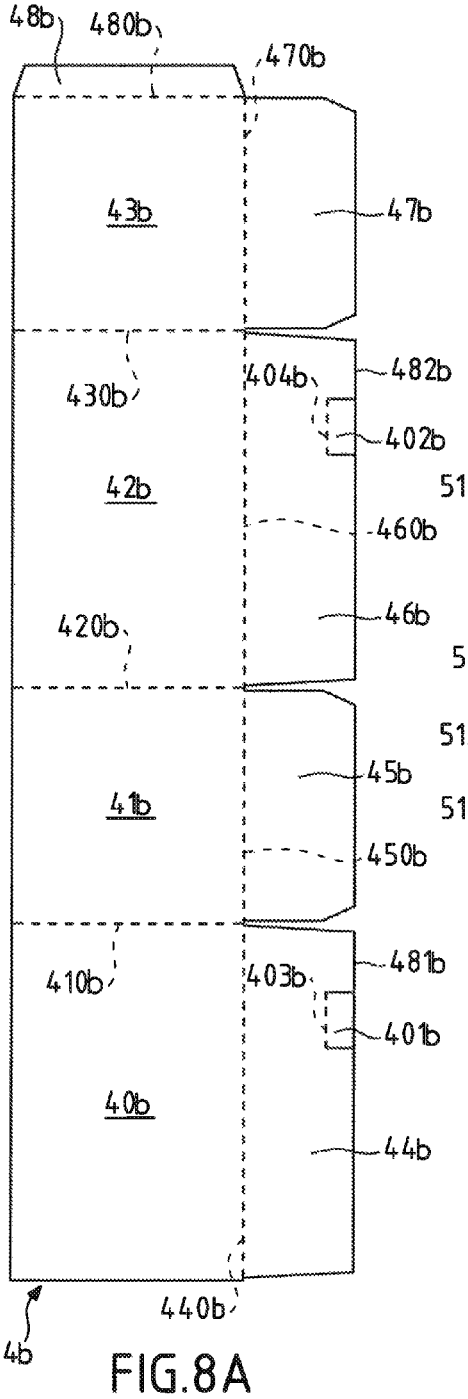
Figure 8B:
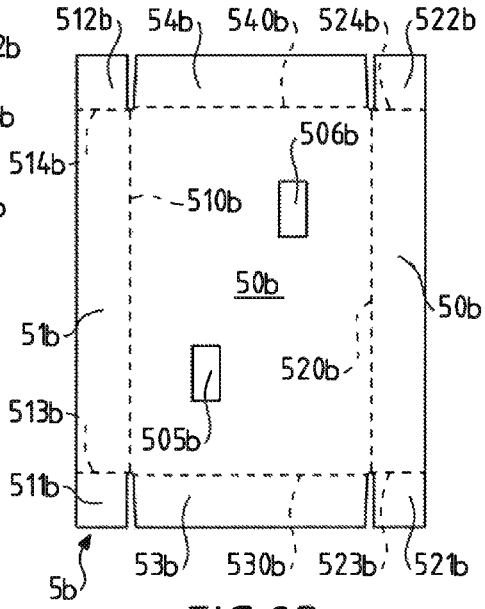

FIG. 8 comprises FIGS. 8A and 8B which are respectively views from above of a first blank forming the tray and a second blank forming the lid of another variant of the box according to FIG. 1.

Figure 9:
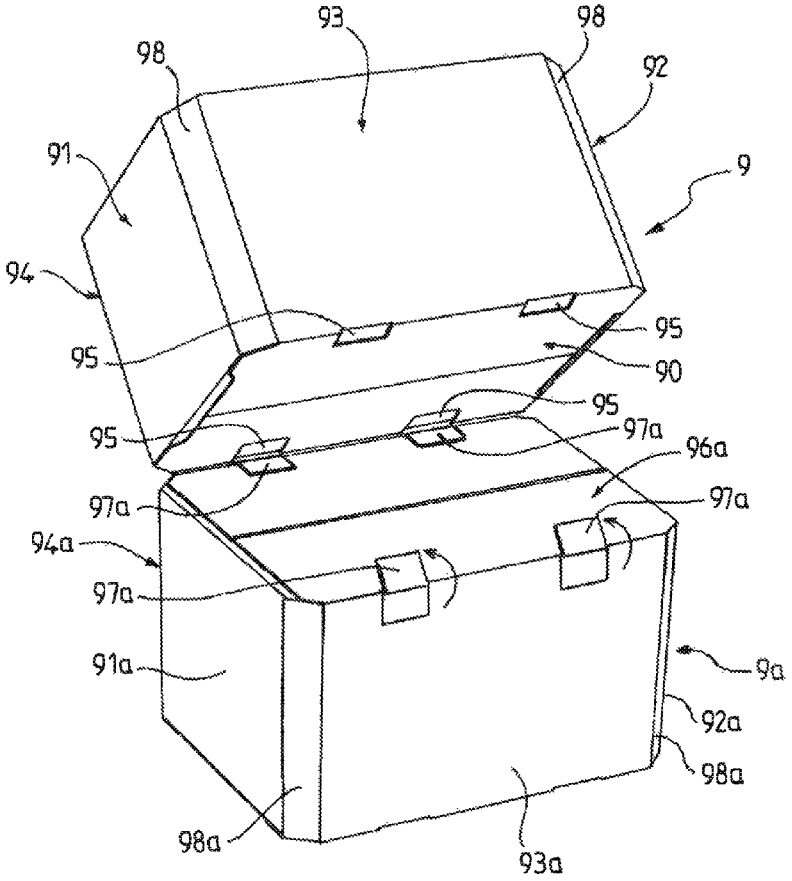

FIG. 9 is a perspective view showing the fitting together of two boxes according to another embodiment of the invention.

Figure 10:
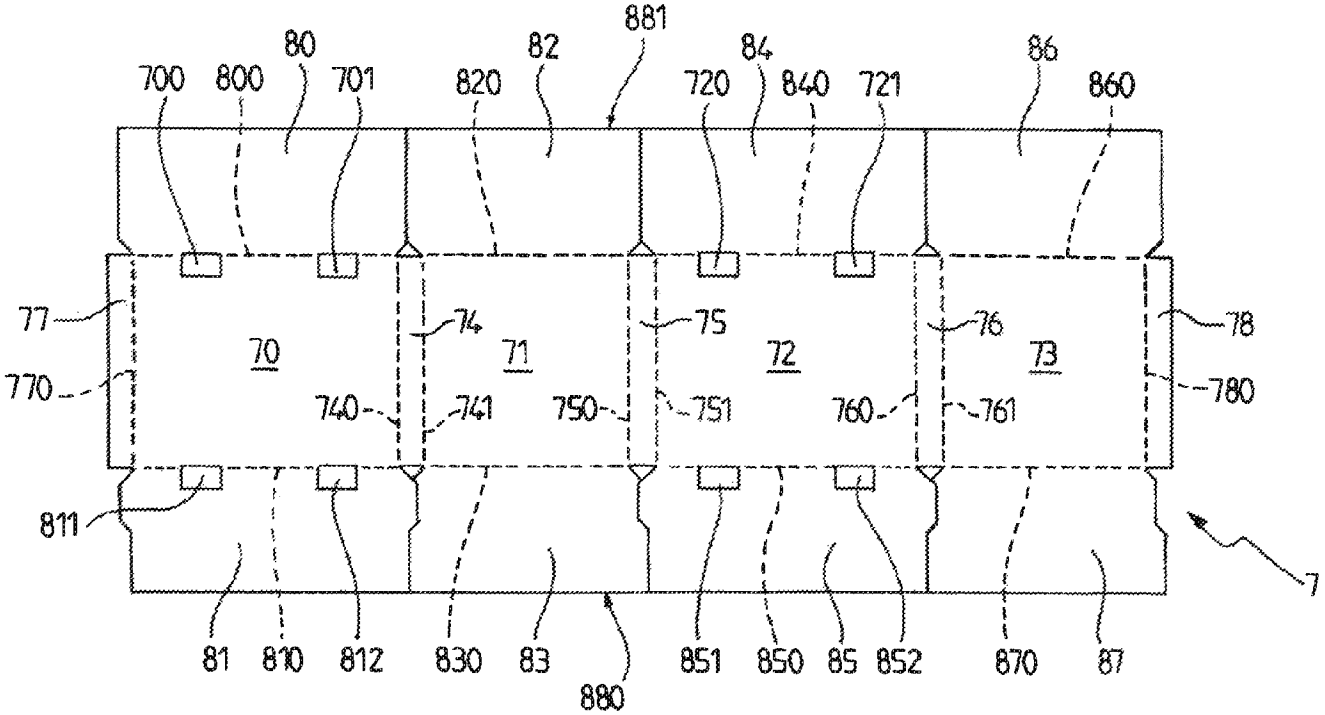

FIG. 10 is a view from above of a third blank forming a box shown in FIG. 9.

Figure 11:
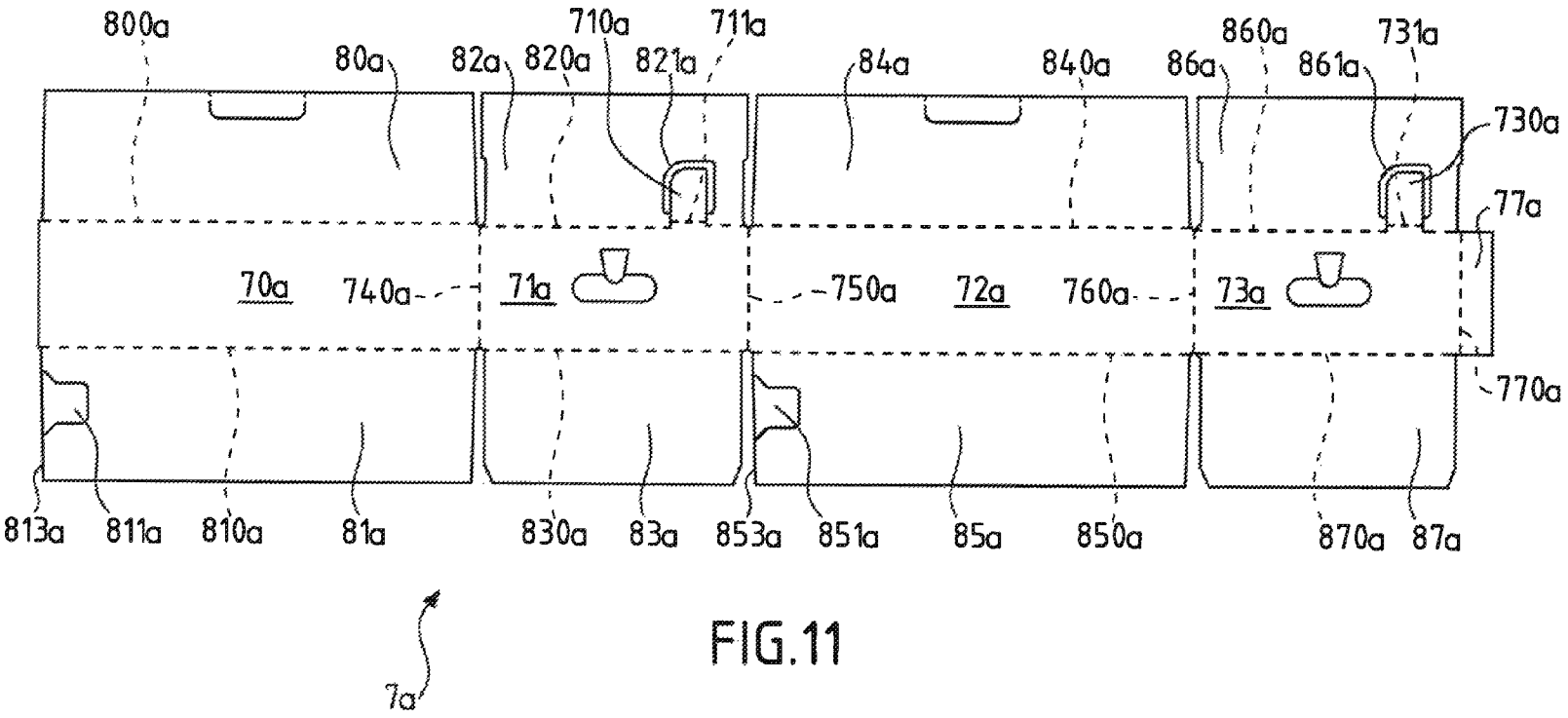

FIG. 11 is a view from above of a first variant of the blank forming a box of the type shown in FIG. 9.

Figure 12:
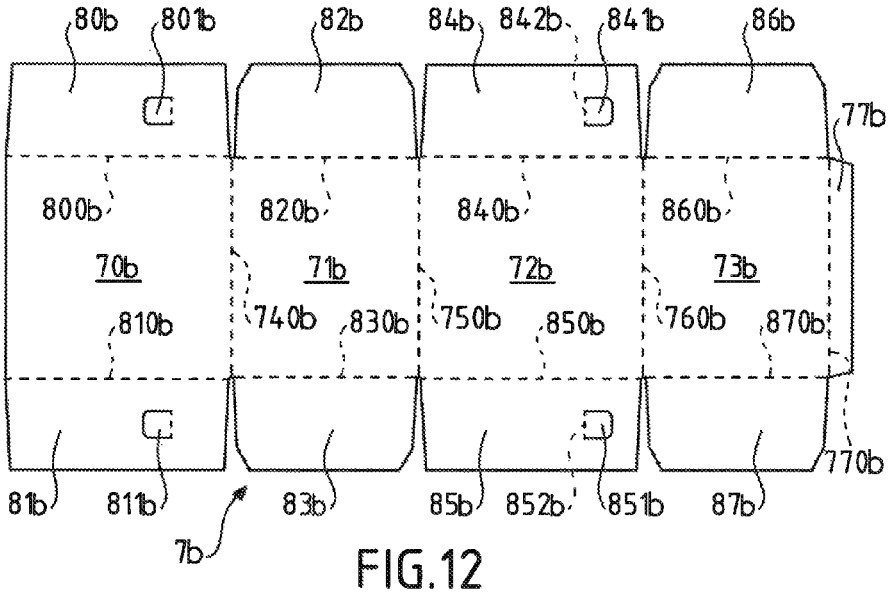

FIG. 12 is a view from above of a second variant of the blank forming a box of the type shown in FIG. 9.

Figure 13:
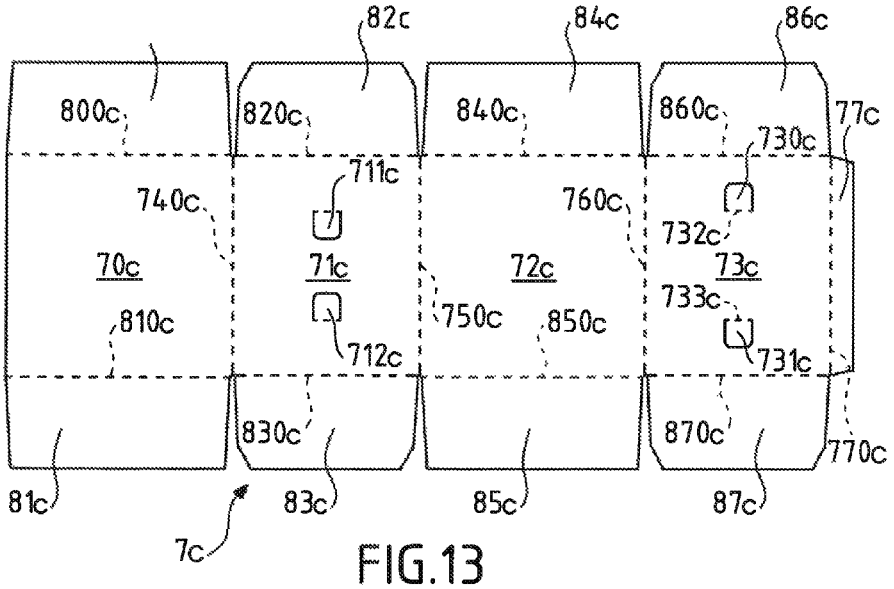

FIG. 13 is a view from above of a third variant of the blank forming a box of the type shown in FIG. 9.

Figure 14A:
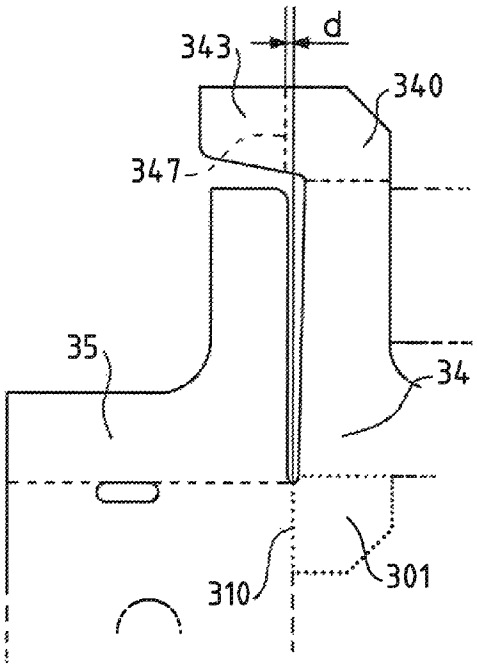
Figure 14:
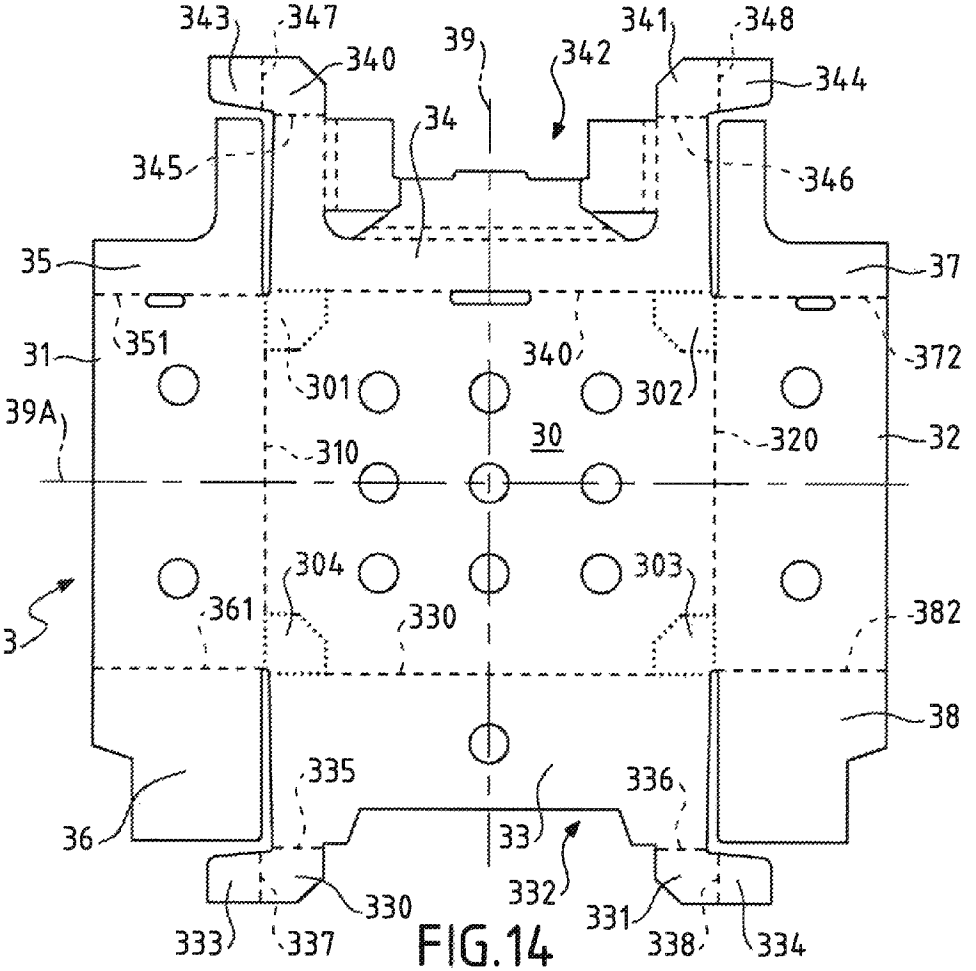

FIG. 14 is a view from above of a blank forming a tray with flanges in the corners and FIG. 14A shows a detail of FIG. 14.

Figure 15A:
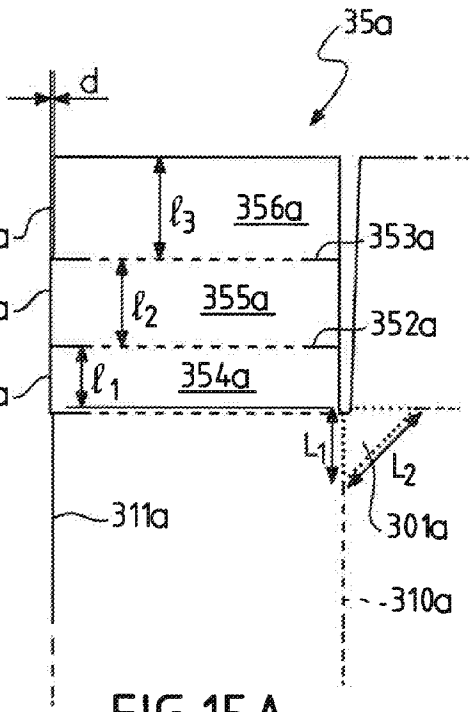
Figure 15:
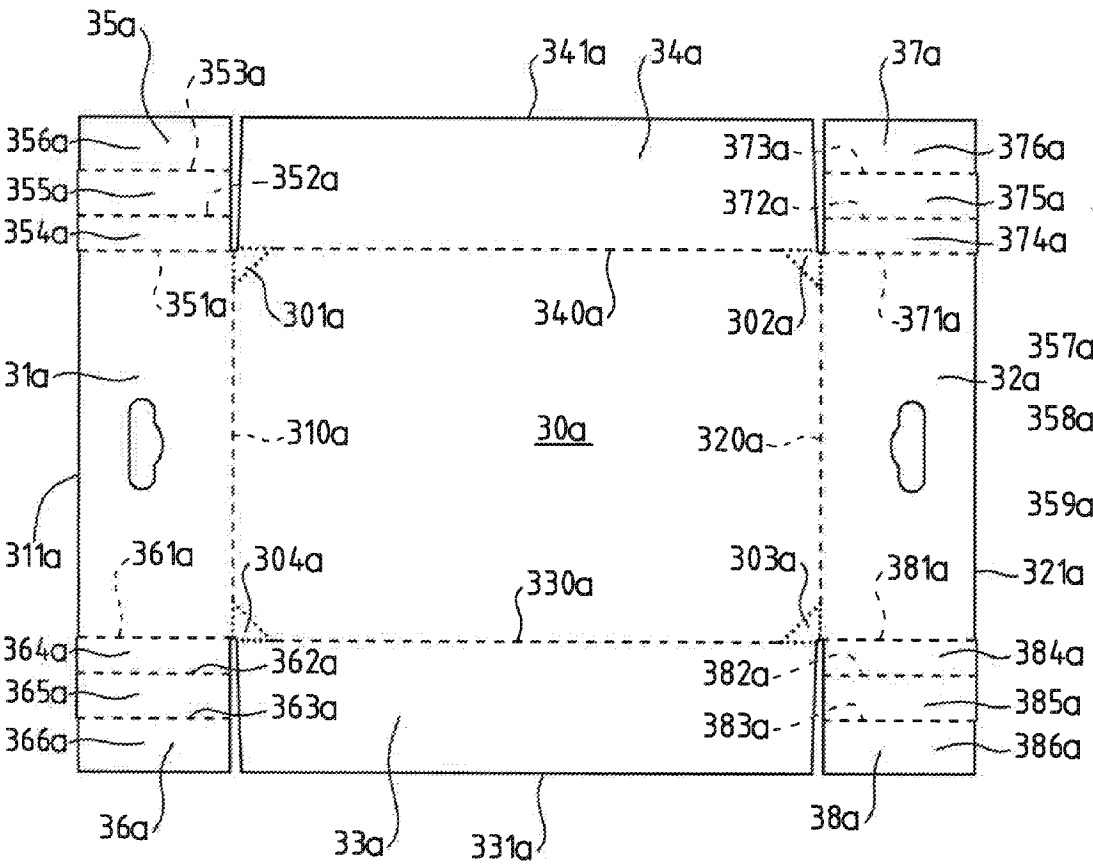

FIG. 15 is a view from above of a blank forming a totally open tray and FIG. 15A shows a detail of FIG. 15.

In the remainder of the description and wherever possible the same reference numbers will be used to designate the same elements or similar elements.

FIGS. 1 to 13 concern a first type of packaging according to the invention taking the form of a box with a bottom and an upper wall constituting the top of the box.

Reference is made first to FIG. 1 which shows a first box formed of a tray 1*a* and a lid 2 fitting into one another together with the tray 1 of a second box intended to be placed on the lid 2 of the first box when the two boxes are stacked.

The material constituting these boxes is a corrugated cardboard sheet for example 3 mm thick.

Each tray 1, 1*a* includes a lower wall 10, 10*a* forming the bottom of the box. The latter is surrounded by four lateral walls 11 to 14, 11*a* to 14*a*.

The lid 2 of a box includes an upper wall 20 forming the top of the box and that is equally surrounded by four lateral walls 21 to 24.

The lateral walls of the lid and of the tray may include openings 17, 27, 17*a* to facilitate holding them.

The bottom wall of the tray of a box includes on its external surface a compressed non-through hollow portion.

This non-through hollow surface portion is designated by the reference 15 in FIG. 1 and is shown in more detail in FIG. 1A.

As will be explained in more detail in the remainder of the description, this hollow surface portion 15 is obtained by cutting the cardboard sheet used to produce the box over a portion of its thickness, the portion of the sheet cut in this way then being compressed.

The reference e in FIG. 1A corresponds to the distance between the external surface of the lower wall 10 of the box and the bottom of the non-through hollow surface portion 15. It is called the thickness of the hollow surface portion 15. It is between ¼ and 9/10 inclusive the thickness of the cardboard sheet used to produce the box.

Moreover, the upper wall of the lid of a box includes a projecting surface portion.

This projecting surface portion on the upper wall 20 of the lid 2 is identified by the reference 25, 26.

The non-through hollow surface portion 15, 16 of the tray 1 has a shape complementary to the projecting surface portion 25, 26 of the lid 2 of the box intended to be placed under the tray 1.

Moreover, this non-through hollow surface portion 15, is produced in line with the projecting surface portion 25, 26 so that the portions 25 and 15, 26 and 16 can fit one inside the other.

The cooperation between the non-through hollow surface portion of a box and the projecting surface portion of another box intended to be placed underneath enables effective centering between the two boxes. This centering is obtained without a hole being formed in the bottom of the boxes.

It is therefore no longer necessary to provide an intermediate portion in the tray of the box to plug cavities in its lower wall and therefore to exclude dust and to assure better hygiene.

This is in particular useful when the cardboard sheet forming the box has a small thickness.

Moreover, the absence of holes ensures better strength of the bottom of the box, the risks of tears starting being eliminated.

Of course, the invention is not limited to the embodiment shown in FIGS. 1 and 1A. Thus other box shapes could be envisaged. For example, the box has a polygonal section, the latter not necessarily being rectangular as in the box shown in FIG. 1. Moreover, the upper wall forming the top of the box and the lower wall forming its bottom could include only one or more than two projecting and non-through hollow surface portions.

Figure 3:
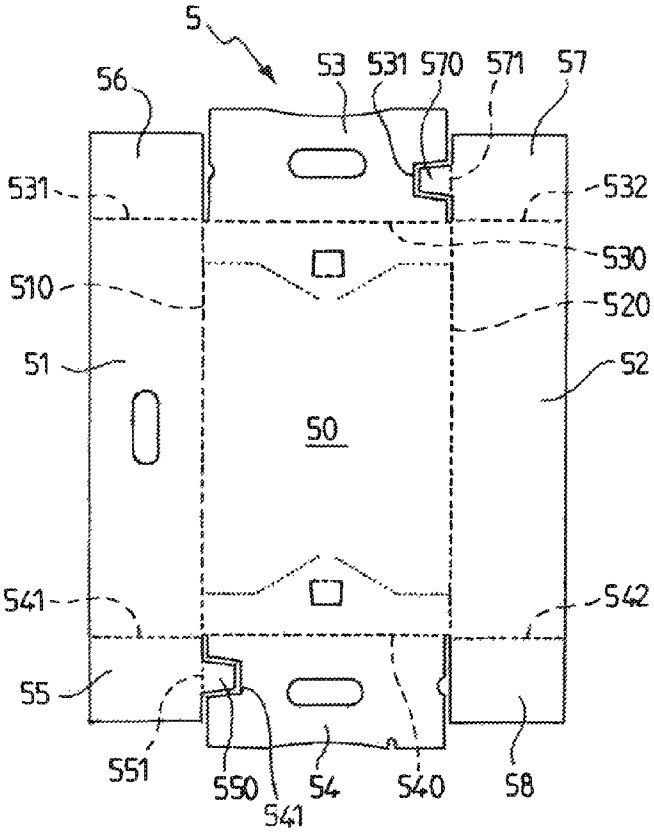
FIGS. 2 and 3 are respectively views from above of a first blank forming the tray and a second blank forming the lid of a box from FIG. 1.
Figure 2:
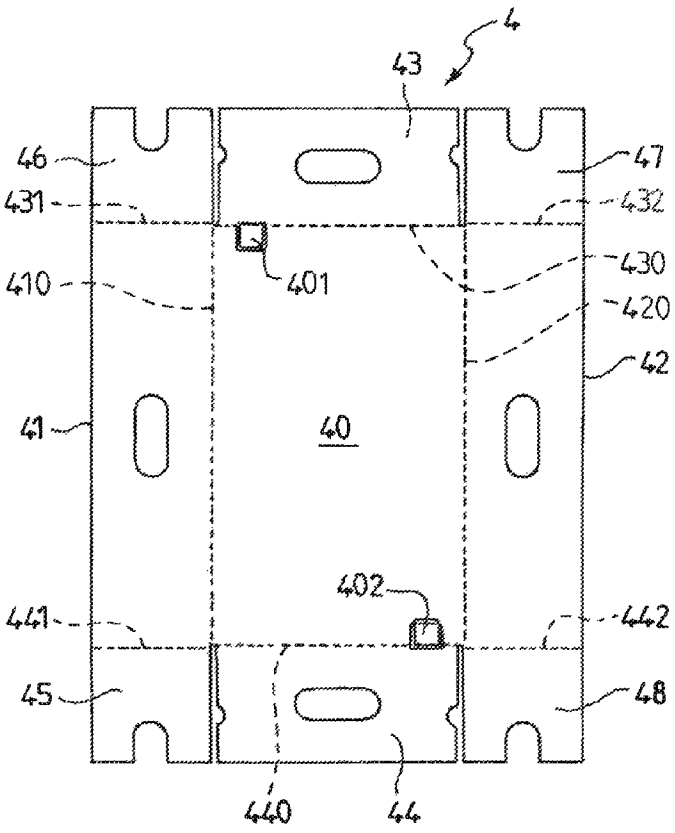

Reference is now made to FIGS. 2 and 3 showing blanks enabling a box of the type shown in FIG. 1 to be obtained.

Accordingly, FIG. 2 shows a first blank 4 intended to form the trays 1, 1*a* shown in FIG. 1.

This first blank includes a first main section 40, here of rectangular shape, forming the bottom of the tray of the box.

This first main section 40 is provided on each of its sides with a first rectangular main flap 41 to 44, each of these flaps 41 to 44 being connected to the first main section 40 by a fold or junction line 410 to 440.

The blank 4 shown in FIG. 2 equally includes first substantially square secondary flaps 45 to 48.

The secondary flaps 45 and 46 are disposed on respective opposite sides of the main flap 41 and are connected to it by a fold line 431 and 441. These two fold lines are substantially in line with the fold lines 430 and 440.

Likewise, the secondary flaps 47 and 48 are disposed on respective opposite sides of the main flap 42 and are connected to it by the fold lines 432 and 442. These two fold lines 432 and 442 are in line with the fold lines 430, 440.

FIG. 2 further shows two non-through hollow compressed surface portions 401 and 402, each situated near a fold line 430, 440.

Here they have a substantially square shape. As a general rule, they are of trapezoidal shape.

FIG. 2 shows that the surface portions 401 and 402 straddle the fold or junction line 430, 440. In another embodiment, the portions could have a side beside the fold line 430 or 440 concerned.

Moreover, these two hollow surface portions 401 and 402 are offset relative to one another. They are disposed in a substantially symmetrical fashion with respect to the center of the first main section 40.

The tray of a box is obtained by folding the various flaps about the fold lines so that the hollow surface portions are situated on the outside of the tray.

The secondary flaps are then folded and glued.

Thus the flaps 46 and 47 are folded and fixed to the first main flap 43 and the secondary flaps 45 and 48 are folded and glued to the first main flap 44.

The first flaps 41 to 44 therefore form the lateral walls of the tray.

These folding and shaping steps enable the four lateral walls 11 to 14 and 31 to 34 of a tray such as that referenced 1 or 1*a* in FIG. 1 to be obtained.

FIG. 3 shows a second blank 5 intended to form the lid of a box.

This second blank 5 comprises a second main section 50, here of rectangular shape, intended to form the top of the lid and therefore of the box.

This second main section 50 is provided on each of its sides with a rectangular second main flap 51 to 54. Each second main flap is connected to the second main section 50 by a fold line 510, 520, 530, 540.

The second blank 5 equally includes rectangular second secondary flaps 55 to 58. Thus two secondary flaps 55, are provided on respective opposite sides of the second main flap 51 and are connected to it by fold lines 531, 541.

Likewise, two secondary flaps 57, 58 are provided on respective opposite sides of the second main flap 52 and are connected to it by the fold lines 532, 542.

The fold lines 530 to 532 and 540 to 542 are substantially in line with one another.

FIG. 3 shows that the second secondary flap 55 includes a protruding portion 550 connected to the secondary flap 55 by a fold line 551. The latter is substantially in line with the fold line 510. The portion 550 therefore equally forms a flap. Likewise, the second secondary flap 57 includes a protruding portion 570 that is connected to it by a fold line 571 so as to form a flap. The fold line 571 is substantially in line with the fold line 520.

The protruding parts 550, 570 extend into a corresponding opening 531, 542 of the corresponding flap 53, 54.

A lid can be formed from the second blank by folding the main flaps and the secondary flaps about the fold lines and fixing the secondary flaps to the corresponding main flap.

Thus the secondary flaps 56 and 57 are folded and fixed to the main flap 53 so as to form one of the lateral walls of the lid. Likewise, the secondary flaps 55 and 58 are folded and fixed to the main flap 54 so as to form another lateral wall.

The other two lateral walls of the lid are formed by the main flaps 51 and 52.

When the second flap 57 is folded and fixed to the main flap 53, the flap 570, folded about the fold line 571, can be folded and glued to the exterior face of the second main section 50.

Likewise, after folding the secondary section 55 over the second main flap 54, the flap 550 can be folded about the fold line 551 and then folded and glued to the exterior face of the second main section 55.

This makes it possible to form the projecting surface portions that bear the references 25 and 26 in FIG. 1.

These flaps 550 and 570 are designed so as to be able to cooperate with the hollow surface portions 401 and 402 provided on the first blank shown in FIG. 2.

In practice, the hollow surface portions 401 and 402 are therefore provided near the fold lines 410 and 420.

There will now be described the process whereby a non-through hollow surface portion may be obtained on a blank such as the first blank shown in FIG. 2.

As a general rule, this blank is obtained from a corrugated cardboard sheet that is cut and locally weakened to obtain the various flaps and fold lines as described with reference to FIG. 2.

Firstly, one or more surface portions of the external face of the first main section 40 are cut over part of the thickness of the cardboard sheet forming the blank. This cut is produced by means of a counter punch on a cutting machine traditionally used by the manufacturers of corrugated cardboard.

It is important here that the cardboard sheet is cut over only part of its thickness. In effect, this makes it possible to preserve intact the internal face of the cardboard sheet and not to pierce that sheet.

Secondly, each cut surface portion is compressed, which forms to shape the cut produced in the cardboard sheet.

FIG. 4 shows a system making it possible to carry out this compression step. Its operation will be described with reference to FIGS. 5A to 5C.

FIG. 4 is a transverse view of the portion of the device making it possible to carry out this compression step. In other words, this view is perpendicular to the direction of movement of the blanks.

The system includes two support devices 60, 61 on each of which is mounted a punch 62, 63 which is mobile in vertical translation between a low position shown in FIG. 5A and a high position shown in FIG. 5B. Pneumatic actuation may be provided for the two punches.

The system equally includes two elongate parts 64 and 65 taking the form of a former that extend in the direction of movement of the blanks and that are situated in line with the elements 60 and 61 to serve as counter punches. These two parts are mobile in translation in a direction perpendicular to the plane of the blank 4 between a high position allowing the blank to pass and a low position in which the parts 64 and 65 are in contact with the blank, thanks to pneumatic actuation for example.

These various means are used in the following manner.

FIG. 5A shows the exterior face of a first blank 4 such as that shown in FIG. 2.

On the first main section 40 and slightly overlapping the fold line 430 with the main flap 43 the blank includes a surface portion cut over part of the thickness of the cardboard sheet forming the first blank. This portion is identified by the reference 400.

When this surface portion 400 is located facing the punch 62, the latter is actuated to move from the low position shown in FIG. 5A to the high position shown in FIG. 5B.

In this position, the punch 62 penetrates into the first main section 40. Thanks to the presence of the part 64 forming the counter punch, then in the low position, the punch 62 is able to compress the cut surface portion 400.

The punch 62 is actuated again to move from the high position shown in FIG. 5B to the low position shown in FIG. 5C.

The non-through hollow surface portion 401 is then formed.

The punch 63 and the counter punch 65 are used to form the other non-through hollow surface portion 402 provided on the external face of the first main section 40.

The operation and the use of the punch 63 and of the counter punch 65 will not be described in detail since they are identical to those described above with reference to FIGS. 5A to 5C.

Figure 6:
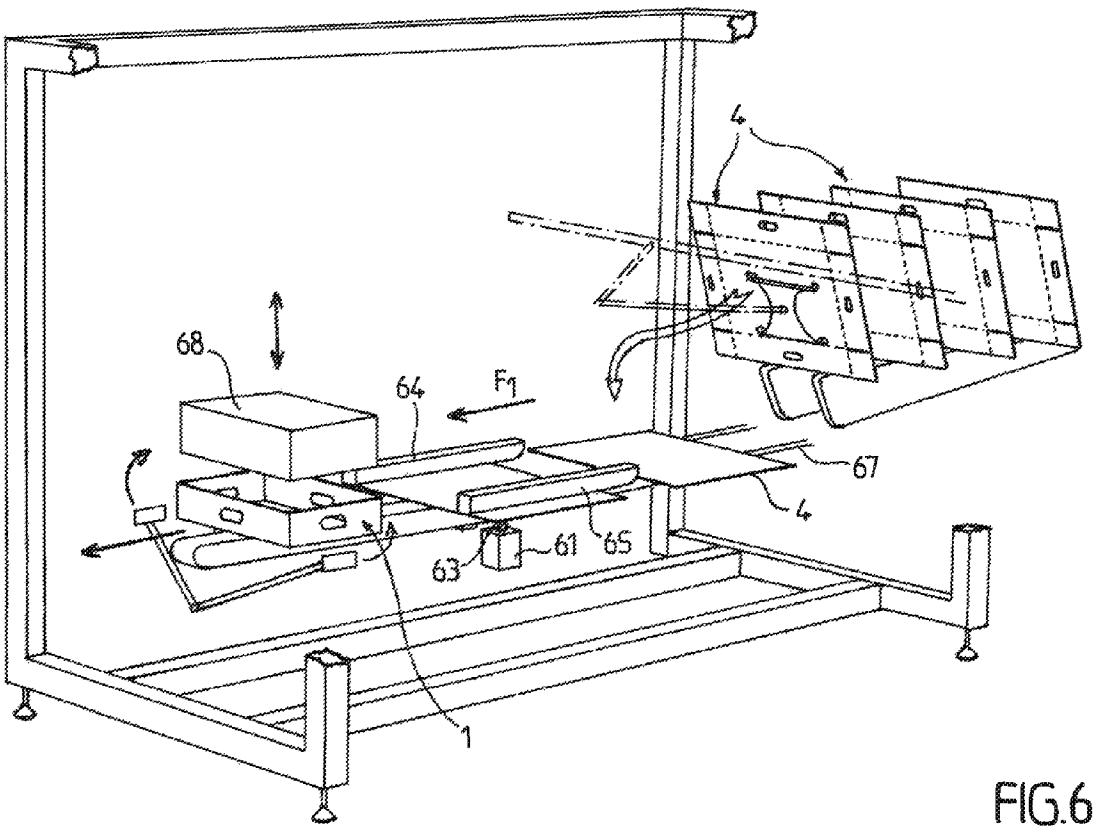
FIG. 6 is a diagrammatic partial perspective view of one embodiment of the device according to the invention.

Reference is now made to FIG. 6 which shows a device making it possible to execute all the steps of fabrication of a tray of a box as shown in FIG. 2.

This device is fed with first blanks 4 as shown in FIG. 2.

These blanks 4 include on their exterior face at least one surface portion cut over part of the thickness of the cardboard sheet, such as the portion 400 shown in FIG. 5A.

These first blanks 4 are disposed in a stack and extend substantially vertically.

The method therefore consists in unstacking a blank 4 and depositing it on a conveyor 67. The latter moves in translation, the direction of movement being designated by the arrow F1.

It should be noted that the blank 4 is disposed flat on the conveyor 67, its external face including the cut surface portion 400 being in contact with the conveyor 67.

The blank 4 is then fed by the conveyor to the system that has just been described with reference to FIGS. 4 and 5A to 5B.

The elongate parts 64 and 65 are then in the high position and the blank 4 is able to pass between them.

When the punches 62 and 63 are positioned facing the cut surface portions provided on the external face of the blank 4 they are actuated so as to pass from a low position to a high position while the parts 64 and 65 are actuated to move from a high position to a low position.

As described above with reference to FIGS. 5A to 5C, each punch can therefore penetrate into the first main section 40 of the blank 4. Thanks to the presence of the parts 64, 65 forming counter punches, each punch 62, 63 is therefore able to compress the cut surface portion to form the non-through hollow portions 401 and 402.

The blank 4 is then fed to a final station in which the main and secondary flaps of the blank 4 are folded around a former 68 so as to form the lateral walls of the tray 1.

The former is mobile in translation in a direction perpendicular to the plane of the conveyor 67 between a high position shown in FIG. 6 and a low position in which the tray is formed to shape around the former by means known to the person skilled in the art that are not described in detail.

In parallel with this, the lid 2 of the box is produced from the second blank 5 shown in FIG. 3 in the classic manner on another device.

The invention is of course not limited to this device. It is generally concerned with any device enabling production of at least one non-through hollow surface portion in the bottom of a packaging whether the latter includes a tray or is constituted of a tray or takes the form of a box obtained from a single blank wrapped or not around a former.

Reference is now made to FIGS. 7A, 7B and 8A, 8B which show variant embodiments of the blanks shown in FIGS. 2 and 3.

Thus FIG. 7A shows a first blank 4*a* intended to form a tray while FIG. 7B shows a second blank 5*b* intended to form a lid of a box of the type shown in FIG. 1.

The first blank 4*a* includes a main section 40*b* forming the bottom of the tray of the box.

This first main section, here of rectangular shape, is provided on each of its longer sides with a rectangular secondary section 41*a*, 42*a*, each of these secondary sections being connected to the main section by a fold or junction line 412*a*, 422*a*.

Moreover, each of the main or secondary sections is provided on respective opposite sides with flaps 400*a*, 403*a*; 410*a*, 411*a*; 420*a*, 421*a* connected by junction lines 404*a*, 405*a*; 412*a*, 413*a*; 422*a*, 423*a*.

FIG. 7A further shows two compressed non-through hollow surface portions 401*a* and 402*a*.

These hollow surface portions will not be described in detail again.

FIG. 7A shows that the two hollow surface portions 401*a* and 402*b* are, once again, offset relative to one another and disposed in a substantially symmetrical manner with respect to the center of the main section 40*a*.

FIG. 7A shows that, in contrast to the embodiment shown in FIG. 2, the hollow portions 401*a*, 402*a* do not straddle the junction or fold line 412*a*, 422*a* and do not have a side beside that fold line either.

To the contrary, these hollow portions are far away from all the fold lines connecting the main section 40*a* to a secondary section 41*a*, 42*b* or to a flap 400*a*, 403*a*.

A tray is obtained by folding the secondary sections and the flaps about the fold lines and fixing the flaps together so that the hollow surface portions 401*a*, 402*a* are situated on the outside of the tray.

FIG. 7B shows a second blank 5*a* intended to form the lid of a box.

This second blank 5*a* comprises a second main flap 50*a*, here of rectangular shape, intended to form the top of the lid and therefore of the box.

This second main section 50*a* is provided on each of its sides with a main flap 51*a* to 54*a* via a fold line 510*a* to 540*a*.

Two main flaps 51*a* and 52*a* include, on respective opposite sides, a secondary flap 511*a*, 512*a*; 521*a*, 522*a* to which it is connected by fold lines 513*a*, 514*a*; 523*a*, 524*a*.

FIG. 7B shows that the main section 50*a* includes two cuts each delimiting a tongue 501*a*, 502*a* connected to the second main section 50*a* by a fold line 503*a*, 504*a*.

The fold lines 503*a*, 504*a* are substantially parallel to the fold lines 530*a*, 540*a*.

When each of the tongues 501*a*, 502*a* is folded about the fold line 503*a*, 504*a* and folded against the second main section 50*a* these folded tongues are situated facing the hollow surface portions 401*a*, 402*a*.

A lid can be formed from the second blank 5*a* by folding the main flaps and the secondary flaps about the fold lines and fixing each secondary flap to the corresponding main flap in the standard manner.

The tongues 501*a* and 502*a* are fixed to the exterior face of the lid obtained in this way.

There are thus obtained a tray and a lid the hollow and projecting portions of which can fit one inside the other.

Reference is now made to FIGS. 8A and 8B which describe another variant of the box shown in FIG. 1.

Thus FIG. 8A shows a blank 4*b* intended to form a lid.

This blank 4*b* includes four main sections 40*b* to 43*b* that are interconnected by a fold line 410*b*, 420*b*, 421*b*.

In the example shown in FIG. 8A the main sections 40*b* and 42*b* have identical rectangular shapes whereas the main sections 41*b* and 43*b* have identical substantially square shapes.

The blank 4*b* equally includes four lateral flaps 44*b* to 47*b*, each of them being connected to a main section 40*b* to 43*b* by a fold line 440*b* to 470*b*, all these fold lines being substantially aligned.

Moreover, the main section 43*b* is extended on the side opposite the section 42*b* by a flap 48*b* to which it is connected by the fold line 480*b*.

FIG. 8A shows that the lateral flaps 44*b* and 46*b* include a cut-out terminating at the exterior edge 481*b*, 482*b* of the flaps and delimiting a tongue 401*b*, 402*b* that is connected to each of the lateral flaps 44*b*, 46*b* by a fold line 403*b*, 404*b*.

The lid of a box is obtained by folding the main sections 40*b* to 43*b* about the fold lines 410*b* to 430*b*, folding the flap 48*b* about the fold line 480*b* and fixing the flap 48*b* to the main section 40*b*.

For their part, the lateral flaps 44*b* to 47*b* are folded contiguously two by two about their fold line 440*b* to 470*b* so that the lateral flaps 44*b* and 46*b* cover the lateral flaps 45*b* and 47*b* and are fixed to the latter. This enables the lid of the box to be obtained.

The tongues 401*b* and 402*b* are then folded about the fold line 403*b*, 404*b*, folded over the secondary section 44*b*, 46*b* concerned and fixed to the latter.

This enables two projecting surface portions to be obtained on the top of the box.

These two projecting portions are thus disposed in a symmetrical manner with respect to the transverse axis of the top of the box.

Reference is now made to FIG. 8B which shows a blank similar to the one that has been shown with reference to FIG. 7B. However, this blank 5*b* will be intended to form a tray and not a lid.

The elements of FIG. 8B that are shared with FIG. 7B are designated by the same numerical references. They are assigned the suffix b like all the references in FIG. 8B. Their description will not be repeated.

The blank 5*b* from the figure differs from the blank 5*a* shown in FIG. 7B in that it includes two compressed non-through hollow surface portions 505*b* and 506*b*, each of them being far away from a fold line 510*b* to 540*b*.

These two hollow portions are offset relative to one another and disposed in a substantially symmetrical manner with respect to the center of the first main section 50*b*.

The tray of a box is obtained by folding the various flaps about the fold lines so that the hollow surface portions 505*b* and 506*b* are situated on the exterior face of the bottom of the tray.

Their positions on the main section 50*b* are chosen so as to be able to face the projecting portions of the lid that will be formed by the flaps 401*a* and 402*a*.

Reference is made now to FIGS. 9 and 10 which correspond to boxes different from those shown in FIG. 1.

In effect, the boxes shown in FIG. 9 are obtained from a single blank, such as the blank 7 shown in FIG. 10.

The blank 7 includes four main sections 70 to 73 that are interconnected by intermediate sections 74 to 76. Each of these intermediate sections is delimited by two fold lines 740, 741; 750, 751 and 760, 761.

In the example shown in FIG. 10, the main sections 70 and 72 have identical rectangular shapes, while the main sections 71 and 73 have a substantially square shape.

These four main sections are intended to form the lateral walls 91 to 94 and 91*a* to 94*a* of the boxes 9 and 9*a* shown in FIG. 9.

The blank 7 shown in FIG. 10 equally includes four sets of two facing lateral flaps connected in pairs to each of the main sections.

Thus the lateral flaps 80 and 81 are disposed on respective opposite sides of the main section 70 and are connected to it by the fold lines 800, 810. The latter extend substantially perpendicularly to the fold lines delimiting the intermediate sections.

Likewise, two lateral flaps 82, 83 are provided on respective opposite sides of the main section 71 and connected to it by the fold lines 820, 830.

On respective opposite sides of the main section 72 are provided the lateral flaps 84 and 85 that are connected to it by the fold lines 840, 841.

Finally, the lateral flaps 86 and 87 are provided on respective opposite sides of the main section 73 to which they are connected by the fold lines 860, 870.

The fold lines 800, 820, 840 and 860 are substantially in line with one another. The same applies to the fold lines 810, 830, 850 and 870.

The lateral flaps 80, 82, 84 and 86 are intended to form the top 96*a* of the box 9*a* shown in FIG. 9.

Moreover, the lateral flaps 81, 83, 85 and 87 are intended to form the bottom of a box shown in FIG. 8, like the bottom 90 of the box 9.

FIG. 10 shows that the lateral flaps 81 and 85 of the blank 7 each include two compressed non-through hollow surface portions 811, 812 and 851, 852.

These surface portions are similar to the surface portion 15 shown in FIG. 1A and will not be described in more detail.

The surface portions 811 and 812 are situated near the fold line 810 while the surface portions 851 and 852 are situated near the fold line 850.

These surface portions are able to straddle the fold line concerned or to have one side beside that fold line.

Moreover, the main section 70 includes two secondary flaps 700 and 701 near the fold line 800 and connected to the lateral flap 80 by the fold line 800.

These two secondary flaps 700 and 701 are situated facing the hollow surface portions 811 and 812.

Likewise, the main section 72 includes two flaps 720 and 721 connected to the lateral flap 84 by the fold line 840. These two flaps are situated facing the hollow surface portions 851 and 852.

The flaps 700, 701, 720 and 721 are designed to be able to cooperate with the hollow surface portions 811, 812, 851 and 852.

The blank 7 equally includes two secondary flaps 77 and 78.

The secondary flap 77 extends the main section 70 on the side opposite the intermediate section 74 and is connected to it by the fold line 770.

The secondary flap 78 extends the main section 73 on the side opposite the intermediate section 76 and is connected to it by the fold line 780.

The boxes 9 and 9*a* shown in FIG. 9 are obtained from the blank 7 shown in FIG. 10 by folding the main sections 70 to 73 about the fold lines 770, 740, 741, 750, 751, 760, 761 and 780, these various main sections thus forming the lateral walls 91 to 94 and 91*a* to 94*a* of the boxes 9 and 9*a*.

To this end, the secondary flaps 77 and 78 are fixed to one another.

FIG. 9 shows that these lateral walls are connected by intermediate lateral walls 98, 98*a* formed by the intermediate sections 74 to 76 of the blank 7.

The lateral flaps 80, 82, 84 and 86 are folded contiguously two by two so that the sections 80 and 84 cover the lateral flaps 82 and 86 and are fixed to the latter. This enables the top of a box shown in FIG. 9 to be obtained, such as the top 96*a* of the box 9*a*.

The flaps 700 and 701 together with the flaps 720 and 721 are folded about the fold lines 800 and 840 and folded over the main section 80 or 84 concerned and fixed to the latter.

This enables the four projecting surface portions 97*a* present on the top 96*a* of the box 9*a* to be obtained.

These projecting portions 97*a* are disposed in a symmetrical manner with respect to the transverse axis of the box.

Moreover, the lateral flaps 81, 83, 85 and 87 are folded contiguously about the fold lines 810, 830, 850 and 870 and folded so that the lateral flaps 81 and 85 cover the lateral flaps 83 and 87 and can therefore be fixed to the latter. This enables the bottom of a box shown in FIG. 9, such as the bottom 90 of the box 9, to be obtained.

The latter therefore includes four hollow surface portions 95 corresponding to the hollow parts 811, 812, 851 and 852 of the blank 7.

These hollow surface portions 95 are disposed in a symmetrical manner with respect to the transverse axis of the box 9.

FIG. 9 shows that the projecting surface portions 97*a* of the box 9*a* are intended to cooperate with the hollow surface portions 95 of the bottom 90 of the box 9 disposed on top of the box 9*a*. This cooperation enables effective centering between the two boxes without a hole being formed in the bottom of the boxes.

Of course, the invention is not limited to the embodiment shown in FIGS. 9 and 10. For example, the box may have a polygonal, not necessarily rectangular, section.

The shape of the lateral walls of the box could be modified. Moreover, the upper wall forming the top of the box and the lower wall forming its bottom could include a different number of projecting surface portions and non-through hollow portions.

Thus, in a variant, the compressed non-through hollow surface portions 811, 812 and 851, 852 could be provided, still in the lateral flaps 81 and 85, but away from the fold lines 810, 850 and near the exterior longitudinal side 880 of the blank 7.

In this case, the secondary flaps 700, 701; 720, 721 are provided in the lateral flaps 80, 84 and facing the hollow surface portions provided in the lateral flaps 81 and 85.

Each of these secondary flaps may for example extend between the other exterior longitudinal side 890 of the blank 7 and a fold line parallel to that side 890.

The box is formed to shape so that the hollow portions are present on the exterior face of the bottom of the box while the secondary flaps will be present on the exterior face of the top of the box.

The secondary flaps can then be folded about the fold lines, folded over the lateral flaps 80, 84 and fixed to the latter, to obtain four projecting surface portions on the top of the box.

Another variant may for example consist in providing only one compressed non-through hollow surface portion in each lateral flap 81, 85, for example the portions 812 and 852, the latter being situated near the fold line 810, 850.

In this case, only one secondary flap, intended to form a projecting portion, is provided facing each of these hollow portions.

Each of these secondary flaps may be situated in a main section 70, 72 or in a lateral flap 80, 84.

In all cases, the positioning of the secondary flaps and of their fold line and that of the hollow portions are chosen so that the hollow portions and the projecting portions obtained from the secondary flaps are face-to-face when the box is formed to shape.

Another variant embodiment will now be described with reference to FIG. 11.

The blank 7*a* includes four main sections 70*a* to 73*a* that are interconnected by fold lines 740*a*, 750*a* and 760*a*, with no intermediate section.

Moreover, the blank 7*a* includes four sets of two facing lateral flaps connected in pairs to each of the main sections.

This refers to the lateral flaps 80*a* and 81*a* for the section 70*a*, 82*a* and 83*a* for the section 71*a*, 84*a* and 85*a* for the section 72*a* and the sections 86*a* and 87*a* for the section 73*a*.

Fold lines are provided between each main section and each of the two lateral flaps. This refers to the fold lines 800*a*, 820*a*, 840*a* and 860*a*, which are substantially in line with one another, and the fold lines 810*a*, 830*a*, 850*a* and 870*a*, which are also substantially in line with one another.

Moreover, the blank 7*a* equally comprises a secondary flap 77*a* that extends the main section 73*a* on the side opposite the main section 72*a* and that is connected to the main section 73*a* by the fold line 770*a*.

FIG. 11 shows that hollow surface portions are still provided in the lateral flaps 81*a* and 85*a*. However, only one hollow portion 811*a*, 851*a* is provided in each of these lateral flaps. Moreover, each of these portions is situated near a transverse side of the corresponding lateral flap.

Thus the hollow portion 811*a* is situated near the exterior transverse side 813*a* of the lateral flap 81*a* while the hollow portion 851*a* is situated near the transverse side 853*a* of the lateral flap 85*a*, facing the lateral flap 83*a*.

FIG. 11 shows equally that the main flaps 71*a*, 73*a* include a protruding part 710*a*, 730*a* that is connected to it by a fold line 711*a*, 731*a* so as to form a flap.

FIG. 11 shows that the protruding parts 710*a*, 730*a* extend in a corresponding opening 821*a*, 861*a* of the main section 82*a*, 86*a*.

Moreover, the fold lines 711*a*, 731*a* are not aligned with the fold lines 820*a*, 860*a* and are situated inside the protruding parts 710*a*, 730*a*.

A box is obtained from the blank 7*a* by folding the main sections about the fold lines 740*a* to 760*a* and fixing the secondary flap 77*a* to the main section 70*a*, after folding about the line 770*a*.

The lateral flaps 81*a* to 87*a* are folded about the fold lines 810*a* to 870*a* and fixed so that the hollow portions 811*a* and 851*a* are located on the exterior face of the bottom of the box. These two hollow portions are thus substantially symmetrical with respect to the center of the bottom of the box.

The lateral flaps 80*a* to 86*a* are equally folded about the fold lines 800*a* to 860*a* before fixing the secondary flaps 80*a*, 84*a* to the secondary flaps 82*a*, 86*a*, the flaps 710*a* and 730*a* being folded outward about the fold lines 711*a* and 731*a*.

After this fixing, the flaps 710*a* and 730*a* are folded over and stuck to the exterior face of the lateral flaps 80*a*, 84*a*.

These flaps 710*a*, 730*a* then form the projecting parts present on the exterior face of the top of the box.

Reference is now made to FIG. 12 which shows another variant of the blank shown in FIG. 10.

The blank 7*b* shown in FIG. 12 includes four main sections 70*b* to 73*b* interconnected by fold lines 740*b* to 760*b*.

The main section 73*b* is extended on the side opposite the section 72*b* by a secondary flap 77*b* to which it is connected by a fold line 770*b*.

The blank 7*b* equally includes four sets of two facing lateral flaps 80*b*, 81*b*; 82*b*, 83*b*; 84*b*, 85*b*; 86*b*, 87*b* connected in pairs to each of the main sections 70*b* to 73*b*.

The fold lines between the lateral flaps and the sections bear the references 800*b* to 870*b*.

FIG. 12 shows that two compressed non-through hollow surface portions 801*b*, 811*b* are provided in each of the lateral sections 80*b* and 81*b*.

These hollow portions 801*b* and 811*b* are positioned away from the fold lines 800*b* and 810*b*, like sides of the lateral flaps.

Moreover, each of the lateral flaps 84*b*, 85*b* includes a cut-out delimiting a tongue 841*b*, 851*b* connected to the main section 84*b*, 85*b* by a fold line 842*b*, 852*b* forming a flap.

The fold lines 842*b*, 852*b* are substantially perpendicular to the lines 840*b*, 850*b* and are positioned on the same side as the secondary flaps 82*b*, 83*b*.

Once again, a box is obtained from the blank 7*b* by folding the main sections 70*b* to 73*b* about the fold lines 740*b* to 760*b* and fixing the secondary flap 77*b* to the main section 70*b* after folding it about the fold line 770*b*.

The lateral flaps 80*b* to 86*b* are folded contiguously two by two so that the flaps 80*b* and 84*b* cover the flaps 82*b* and 86*b* and are fixed to the latter.

The flap 841*b* is then folded about the fold line 842*b* and then stuck to the exterior face of the lateral flap 84*b*.

A hollow portion 801*b* and a projecting portion 841*b* are therefore obtained on the top of the box obtained in this way that are substantially symmetrical with respect to the center of the top of the box.

The same procedure is followed with the lateral flaps 81*b* to 87*b* so as to obtain on the exterior face of the bottom of the box a hollow portion 811*b* and a projecting portion 851*b* that are symmetrical with respect to the center of the bottom of the box.

The variant shown in FIG. 12 may again be modified, the cut-out in the lateral flaps 84*b* and 85*b* being such that the fold line 842*b*, 852*b* is positioned on the same side as the secondary flap 86*b*, 87*b*. Thus when the lateral walls of the box are erected the flaps 841*b* and 851*b* are folded on the side of the lateral wall defined by the section 73*b*.

The positioning of the hollow portions and of the cut-outs defining the flaps forming the projecting parts is in all cases defined so that the hollow and projecting portions of two superposed boxes are able to nest one in the other.

Reference is now made to FIG. 13 which shows a further variant of the blank shown in FIG. 10.

This blank 7*c* has the same general structure as the blank 7*b* shown in FIG. 12. This is why the elements of the blank 7*c* that are common to the blank 7*b* will carry the same numerical references. They will be assigned the letter c, like all the references in FIG. 13.

The description of the blank 7*c* will not be repeated in detail.

The blank 7*c* differs from the blank 7*b* in that the hollow and projecting parts are not provided on the lateral flaps but on the main sections.

Thus FIG. 13 shows that two hollow portions 711*c*, 712*c* are provided in the main section 71*c*. In this embodiment, these two hollow portions are situated on the median major axis of the main section 71*c* and are symmetrical with respect to the center of the latter.

Moreover, in the main section 73*c* are provided two cuts defining tongues 730*c*, 731*c* able to be folded about the fold lines 732*c*, 733*c*. The latter are substantially parallel to the fold lines 860*c*, 870*c*.

These flaps 730*c*, 731*c* are also situated on the median major axis of the section 73*c* and are symmetrical with respect to the center of the latter.

A box is obtained from this blank 7*c* as explained above with reference to FIG. 12.

The main sections are folded so that the hollow parts 711*c*, 712*c* are located on the exterior face of a wall of the box that constitutes its bottom.

Moreover, the flaps 730*c*, 731*c* are folded about the fold lines 732*c*, 733*c* and then folded over and fixed to the exterior face of the wall constituted by the main section 73*c* that will form the top of the box.

The hollow parts 711*c*, 712*c* and the tongues forming the flaps 730*c*, 731*c* are positioned so that the projecting portions formed by the flaps 730*c*, 731*c* folded over the section 73*c* face the hollow portions 711*c*, 712*c* so as to allow the fitting together of the hollow portions and the projecting portions of two superposed boxes.

Reference is now made to FIGS. 14 and 15 which show a second type of packaging according to the invention taking the form of a tray with a bottom and an upper plane that is defined by the upper free edges of the lateral walls of the tray. It therefore constitutes an open face opposite the bottom.

Thus FIG. 14 shows a blank 3 intended to form a tray that is not intended to receive a lid.

This blank 3 includes a main section 30, here of square shape, forming the bottom of the tray.

This main section 30 is provided on each of its sides with a rectangular main flap 31 to 34, each of these flaps 31 to 34 being connected to the main section 30 by a fold or junction line 310 to 340.

The blank 3 shown in FIG. 14 equally includes secondary flaps on respective opposite sides of the main flaps 31 and 32.

Thus the secondary flaps 35, 36 are disposed on respective opposite sides of the main flap 31 and are connected to it by a fold line 351, 361.

Likewise, secondary flaps 37, 38 are disposed on respective opposite sides of the main flap 32 and are connected to it by the fold lines 372 and 382.

FIG. 14 shows that the secondary flaps 36 and 38 disposed in a symmetrical manner with respect to the median transverse axis 39 of the blank 3 have the same shape. The same applies to the secondary flaps 35 and 37 disposed in a symmetrical manner with respect to the axis 39.

FIG. 14 again shows four compressed and non-through hollow surface portions 301 to 304, each of them being disposed in a corner of the main section 30. They therefore have two sides beside two junction lines 310 to 340.

Here they have a trapezoidal shape and are intended to be present on the exterior face of the bottom of the tray when the latter is erected.

Moreover, each of the main flaps 33, 34 includes on its edge 332, 342 two tongues 330, 331; 340, 341.

Pairs of these tongues 330, 331; 340, 341 are symmetrical with respect to the median transverse axis 39 of the blank 3 that passes through the flaps 33 and 34. They are equally symmetrical with respect to the median transverse axis 39A that passes through the flaps 31 and 32.

Each of these tongues 330, 331; 340, 341 is extended on the side of the secondary flaps 36, 38; 35, 37 by a flap 333, 334; 343, 344.

The tongue 330, 331; 340, 341 is connected to the main flap 33, 34 by a fold line 335, 336; 345, 346 that is substantially parallel to the fold line 330, 340.

Moreover, the flap 333, 334; 343, 344 is connected to the tongue 330, 331; 340, 341 by a fold line 337, 338; 347, 348. The fold lines 337, 347; 338, 348 are parallel to the fold line 310, 320.

However, FIG. 14 shows that the fold lines 337, 347 are offset relative to the line 310 in the direction of the secondary flaps 36, 35.

Likewise, the fold lines 338, 348 are offset relative to the fold line 320 in the direction of the secondary flaps 38, 37.

This offset is identified by the distance d in FIG. 14A that shows to a larger scale the region between the secondary flap 35 and the main flap 34.

A tray is obtained from the blank 3 shown in FIG. 14 by folding the main and secondary flaps about the various fold lines.

Thus the main flaps 31 and 32 are erected and the main flaps 33 and 34 are erected and fixed to the secondary flaps 36, 38; 35, 37.

Each tongue 330, 331, 340, 341 is folded about the fold line 335, 336, 345, 346.

Likewise, each flap 333, 334, 343, 344 is folded about the fold line 337, 338, 347, 348 and fixed against the main flap 31 or 32.

Because of the offset d between on the one hand the fold lines 337, 447 and the fold line 310 and on the other hand the fold lines 338, 348 and the fold line 320, each tongue assumes a convex shape when its flap is fixed to the corresponding main flap.

There is therefore formed at the four corners of the tray a projecting surface portion constituted by the convex tongues 330, 331, 340, 341 facing the compressed non-through hollow surface portions 301 to 304.

These four tongues define (with the free upper edges of the lateral walls 31 to 34) an upper plane opposite the bottom 30.

Thus two trays of this type could be superposed, the projecting portions of the box underneath and the hollow portions of the box on top fitting one in the other.

FIG. 15 shows a blank 3*a* again intended to form a tray with no lid.

This blank 3*a* includes a main section 30*a*, here of rectangular shape, forming the bottom of the tray.

This main section 30*a* is provided on each of its sides with a rectangular main flap 31*a* to 34*a* each connected to the main section 30*a* by a fold or junction line 310*a* to 340*a*.

On respective opposite sides of each of the main flaps 31*a* and 32*a* there are provided secondary flaps 35*a*, 36*a*; 37*a*, 38*a*.

The blank 3*a* is symmetrical with respect to a median longitudinal axis and with respect to a median transverse axis.

FIG. 15 also shows that the blank 3*a* includes four compressed non-through hollow surface portions 301*a* to 304*a* each disposed in a corner of the main section 30*a*. They therefore have two sides on two junction lines 310*a* to 340*a*.

Here they take the form of an isosceles triangle and are intended to be present on the exterior face of the bottom of the tray when the latter is erected.

The secondary flaps 35*a*, 36*a*; 37*a*, 38*a* are connected to the main flap 31*a*, 32*a* by a junction line 351*a*, 361*a*; 371*a*, 380*a*.

All these secondary flaps 35*a* to 38*a* have the same structure that will be described with reference to the secondary flap 35*a*.

The secondary flap 35*a* includes two fold lines 352*a*, 353*a* that are substantially parallel to the fold line 351*a*.

They therefore define three panels that will be described in more detail with reference to FIG. 15A which shows to a larger scale the region of the secondary flap 35*a*.

The first panel 354*a* has a width 11 slightly less than the length $L_1$ of the shorter side of the hollow portions 301*a*.

The second panel 355*a* has a width 12 slightly less than the length $L_2$ of the longer side or of the hypotenuse of the projecting portions 301*a*.

Finally, the third panel 356*a* has a width $l_3$ greater than $l_2$.

FIG. 15A shows equally that the exterior transverse edge 357*a* of the third panel 356*a* is aligned with the exterior edge 311*a* of the main flap 31*a*.

On the other hand, the exterior transverse edge 358*a*, 359*a* of the first and second panels 354*a* and 355*a* projects relative to this exterior edge 311*a*.

The offset between the edges 358*a*, 359*a* on the one hand and the edge 311*a* and the exterior transverse edge 357*a* of the third panel on the other hand is identified by the distance d in FIG. 15A.

A tray is obtained from the blank 3*a* by folding the main flaps 31*a* to 34*a* about the junction lines 310*a* to 340*a*.

The secondary flaps 35*a* to 38*a* are also folded about the fold lines 351*a* to 381*a* so that the first panels 354*a*, 374*a* can be fixed to the main flap 34*a* and the first panels 364*a*, 384*a* can be fixed to the main flap 33*a*.

The second panels 355*a* to 385*a* are equally folded about the fold lines 352*a* to 382*a* in the same direction as the first panels.

On the other hand the third panels 356*a* to 386*a* are folded about the fold lines 353*a* to 383*a* in the opposite direction to the first and second panels.

Each third panel 356*a*, 366*a*; 376*a*, 386*a* is then fixed to the main flap 31*a*, 32*a* so that the distance between the fold line 351*a* to 381*a* and the fold line 353*a* to 383*a* is slightly less than $L_1$.

There is therefore obtained in each corner of the tray and at the level of its upper plane opposite the bottom constituted by the main section 30*a* a projecting portion constituted by the first panels 354*a* to 384*a* and the second panels 355*a* to 385*a* that project by the distance d beyond the exterior edge 311*a*, 320*a* of the main flaps 31*a*, 32*a* and equally from the exterior edge 331*a*, 341*a* of the main flaps 33*a* and 34*a* because their height is less than that of the main flaps 31*a* and 32*a*.

Moreover, the pillar obtained by folding the panels of the secondary flaps has a form that can be inscribed in the hollow portions 301*a* to 304*a*, the length $L_1$, $L_2$ being greater than the length $l_1$ and $l_2$.

Here the projecting portions of a tray will be able to fit into the hollow portions of a tray situated on top.

As goes without saying and equally as results from the foregoing description, the present invention is not limited to the embodiments more particularly described. To the contrary it encompasses all variants and in particular those in which the shape of the hollow and projecting portions is different like those of the sections and flaps of the blanks used.

The reference signs inserted after the technical features appearing in the claims have the sole aim of facilitating the understanding of the latter and should not be regarded as limiting the scope.

The invention claimed is:

1. A material packaging made of corrugated cardboard sheet having a determined thickness, said packaging having a polygonal section, including lateral walls, a lower plane forming the bottom of the packaging, and an opposite upper plane, comprising at least one portion (25, 26; 97*a*) projecting with respect to the upper plane, characterized in that the bottom (30, 90) comprises at least one surface portion (15, 16; 95) that is cut over a portion of the thickness of the cardboard sheet, compressed and in the form of a non-through hollow, of complementary shape to said projecting surface portion, in line with the latter and adapted to fit together with the projecting surface portion of the packaging underneath.

2. The packaging as claimed in claim 1 in the form of a box the upper plane of which is an upper wall constituting the top of the box, said at least one projecting portion being formed by a surface portion of the upper wall.

3. The packaging as claimed in claim 2, characterized in that the projecting surface portion (25, 26; 95) is formed by a tongue (550, 570; 501*a*, 502*a*; 401*b*, 402*b*; 700, 701, 720, 721; 710*a*, 730*a*; 841*b*, 851*b*; 730*c*, 731*c*) folded and glued onto the top of the box.

4. The packaging as claimed in claim 3, characterized in that the tongues (501*a*, 502*a*; 401*b*, 402*b*; 700, 701, 720, 721; 730*c*, 731*c*) are formed by a cut-out in the upper wall of the box to which they are connected by a fold line (503*a*, 504*a*; 403*b*, 404*b*; 800, 840; 732*c*, 733*c*).

5. The packaging as claimed in claim 3, characterized in that the bottom and the top of the box include a projecting portion (841*b*, 851*b*) and a hollow portion (801*b*, 811*b*)

symmetrical with respect to the transverse axis and with respect to the center of the box.

6. The packaging as claimed in claim 3, characterized in that the hollow portions (401*a*, 402*a*; 505*b*, 506*b*; 811*a*, 851*a*; 801*b*, 811*b*; 711*c*, 712*c*) are far from the junction lines (422*a*, 412*a*; 404*a*, 405*a*; 510*b* to 530*b*; 850*a*, 810*a*; 800*b*, 810*b*; 820*c*, 830*c*) connecting the lateral walls to the bottom.

7. The packaging as claimed in claim 2, characterized in that the projecting surface portions are symmetrical with respect to the transverse axis and/or to the center of the box and formed by tongues (550, 570; 501*a*, 502*a*; 401*b*, 402*b*; 700, 701, 720, 721; 710*a*, 730*a*; 730*c*, 731*c*) folded and glued onto the exterior face of the top of said box.

8. The packaging as claimed in claim 1 in the form of a tray the upper plane of which is an open face.

9. The packaging as claimed in claim 8, characterized in that the projecting portion is formed by a convex tongue (330, 331; 340, 341) situated in one corner of the upper plane of the tray.

10. The packaging as claimed in claim 8, characterized in that two lateral walls (31*a*, 32*a*) of the tray include a pair of facing secondary flaps (35*a*, 36*a*; 37*a*, 38*a*), at least one of them being folded on itself thanks to fold lines (352*a*, 353*a*; 362*a*, 363*a*; 372*a*, 373*a*; 382*a*, 383*a*) to form the projecting portion.

11. The packaging as claimed in claim 1, characterized in that the lower wall (10) and the lateral walls (11 to 14) are formed at least in part by a tray (1*a*) and the upper wall by a lid (2) provided with lateral flaps (21 to 24) covering at least in part the lateral walls of the tray.

12. The packaging as claimed in claim 11, characterized in that the tongues (550, 570) are flaps connected by fold lines (551, 571) to secondary flaps (55, 57) themselves connected to said main flaps (51, 52) of the lid.

13. The packaging as claimed in claim 1, characterized in that it is formed by a sequence of at least four main sections (70 to 73; 70*a* to 73*a*; 70*b* to 73*b*; 70*c* to 73*c*) adapted to form the lateral walls and by four sets of two facing lateral flaps (80, 81; 82, 83; 84, 85; 86, 87; 80*a*, 81*a*; 82*a*, 83*a*; 84*a*, 85*a*; 86*a*, 87*a*; 80*b*, 81*b*; 82*b*, 83*b*; 84*b*, 85*b*; 86*b*, 87*b*; 80*c*, 81*c*; 82*c*, 83*c*; 84*c*, 85*c*; 86*c*, 87*c*) connected in pairs to each of the main sections to form once folded the bottom and the top of the packaging.

14. The packaging as claimed in claim 13, characterized in that each tongue (710*a*, 730*a*) is formed by a flap connected by a fold line (711*a*, 731*a*) to a main section (70*a*, 71*a*).

15. The packaging as claimed in claim 1, characterized in that the lateral walls (41 to 44; 70 to 73) being connected to the bottom by junction lines (410 to 440; 810 to 840), the compressed surface portions (401, 402; 811, 812; 851, 852) straddle the junction line and/or have a side beside said junction line.

16. A blank or set of blanks made of corrugated cardboard sheet having a determined thickness and intended to form packaging of polygonal section including lateral walls, a lower plane forming the bottom of the packaging and an opposite upper plane, characterized in that, the packaging comprising at least one portion projecting relative to the upper plane and the bottom comprising at least one compressed non-through hollow surface portion, termed a hollow portion, cut over a portion of the thickness of the cardboard sheet, of complementary shape to said projecting portion, and adapted to be fitted together with the projecting portion of the packaging underneath when it is in line with the latter, once the packaging has been formed to shape.

17. A set of blanks as claimed in claim 16, characterized in that it comprises a first blank (4, 4*a*, 5*b*) comprising the lower wall formed by a rectangular first main section (40, 40*a*, 50*b*) forming the bottom provided on each of its sides with a flap (41 to 44; 50*b* to 53*b*; 400*a*, 403*a*) or a secondary flap (41*a*, 42*a*) to form the lateral walls of a tray and a second blank (5, 5*a*, 4*b*) comprising the upper wall.

18. The set of blanks as claimed in claim 17, characterized in that the upper wall is formed by a rectangular second main section (50, 50*a*) forming the top, provided on each of its sides with a second main flap (51 to 54; 51*a* to 54*a*) to form the lateral walls of a lid of the packaging once erected.

19. The set of blanks as claimed in claim 17, characterized in that the second blank (4*b*) is formed by a sequence of at least four main sections (40*b* to 43*b*) adapted to form the lateral walls of the lid and by four lateral flaps (44*b* to 47*b*) connected to each of the main sections, to form the top of the lid once folded contiguously.

20. The blank as claimed in claim 16, characterized in that it is formed by a sequence of at least four main sections (70 to 73; 70*a* to 73*a*; 70*b* to 73*b*; 70*c* to 73*c*) adapted to form the lateral walls of a box and by four sets of two facing lateral flaps (80, 81; 82, 83; 84, 85; 86, 87; 80*a*, 81*a*; 82*a*, 83*a*; 84*a*, 85*a*; 86*a*, 87*a*; 80*b*, 81*b*; 82*b*, 83*b*; 84*b*, 85*b*; 86*b*, 87*b*; 80*c*, 81*c*; 82*c*, 83*c*; 84*c*, 85*c*; 86*c*, 87*c*) connected in pairs to each of the main sections to form the bottom and the top of the box once folded contiguously.

21. The blank as claimed in claim 16, characterized in that it comprises a main section (30, 30*a*) forming the bottom of a tray, provided on each of its sides with a main flap (31 to 34; 31*a* to 34*a*) to form the lateral walls of the tray, once erected.

22. The blank or set of blanks as claimed in claim 16, characterized in that the cut and compressed surface portions are of trapezoidal shape.

23. The blank or set of blanks as claimed in claim 16, characterized in that, the lateral walls (41 to 44; 70 to 73; 31 to 34; 31*a* to 34*a*) being connected to the bottom by junction lines (410 to 440; 810 to 840; 310 to 340; 310*a* to 340*a*), the cut and compressed surface portions (401, 402; 811, 812; 851, 852; 301 to 304; 301*a* to 304*a*) straddle the junction line and/or have a side beside said junction line.

24. A device for forming packaging and/or at least one centering member of such packaging made of corrugated cardboard sheets and having a polygonal section, including lateral walls, a lower plane forming the bottom of the packaging and an opposite upper plane, said member comprising a hollow portion provided on the lower face of the bottom and a portion projecting relative to the upper plane of the packaging of complementary shape to and in line with said hollow portion, characterized in that the device includes means (67) for bringing the wall forming the bottom of the packaging into a particular position, in that at least one surface portion (400) of the external face of said bottom having been cut beforehand over a portion of the thickness of the cardboard sheet forming the bottom, it further includes

- at least one part (62, 63) for compressing said cut surface,
- at least one counter-pressure member (64, 65) facing said compression part,
- and pusher means adapted to compress said cut surface portion between the compression part and the counter-pressure member to form said portion in the form of a non-through hollow.

25. The device as claimed in claim 24, characterized in that the counter-pressure member takes the form of a former.

26. A method of forming packaging made of corrugated cardboard sheet having a polygonal section, including lateral walls, a lower plane forming the bottom of the packaging and an opposite upper plane, from at least one blank featuring a panel adapted to form said bottom, characterized in that the panel intended to form the bottom of the packaging is brought into a particular position, at least one surface portion of the external face of the bottom having been cut beforehand over a portion of the thickness of a cardboard sheet forming said bottom, said cut surface portion is compressed by exerting a counter-pressure in the opposite direction to said compression to form a surface portion in the form of a non-through hollow.

* * * * *